US006321846B1

(12) United States Patent
Rytlewski

(10) Patent No.: US 6,321,846 B1
(45) Date of Patent: Nov. 27, 2001

(54) SEALING DEVICE FOR USE IN SUBSEA WELLS

(75) Inventor: Gary L. Rytlewski, League City, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/512,556

(22) Filed: Feb. 24, 2000

(51) Int. Cl.[7] ..... E21B 33/03

(52) U.S. Cl. ..... 166/363; 166/364; 166/85.4; 251/1.1

(58) Field of Search ..... 166/363, 364, 166/85.4, 77.1, 77.2, 84.4, 84.3, 385; 405/166, 167, 216; 138/96 R, 96 T, 174, 153; 251/1.1, 1.2, 1.3

(56) References Cited

U.S. PATENT DOCUMENTS

| | | | | |
|---|---|---|---|---|
| 2,808,230 | * | 10/1957 | McNeill et al. | 175/7 |
| 3,323,773 | * | 6/1967 | Walker | 251/1.2 |
| 3,621,912 | * | 11/1971 | Wooddy, Jr. | 166/340 |
| 3,638,721 | * | 2/1972 | Harrison | 166/351 |
| 3,667,721 | * | 6/1972 | Vujasinovic | 251/1.1 |
| 4,796,699 | | 1/1989 | Upchurch | 166/250.17 |
| 4,856,595 | | 8/1989 | Upchurch | 166/374 |
| 4,896,722 | | 1/1990 | Upchurch | 166/250.15 |
| 4,915,168 | | 4/1990 | Upchurch | 166/250.15 |
| 4,971,160 | | 11/1990 | Upchurch | 175/4.54 |
| 5,050,675 | | 9/1991 | Upchurch | 166/373 |
| 5,343,944 | * | 9/1994 | Bassinger | 166/84.4 |
| 5,566,753 | * | 10/1996 | Van Winkle et al. | 166/84.1 |
| 5,636,688 | * | 6/1997 | Bassinger | 166/84.4 |
| 6,012,125 | * | 8/2000 | Calder | 166/363 X |
| B1 4,915,168 | | 9/1994 | Upchurch | 166/250.15 |

OTHER PUBLICATIONS

Eastern Oil Tools, Hydrolex Product, "Hydraulic Cable Stuffing Boxes," pp. 10–11, dated before Feb. 24, 2000.

Hydrolex Products Brochure, "Hydraulic Cable Stuffing Boxes", p. 10, no date.

* cited by examiner

*Primary Examiner*—William Neuder
(74) *Attorney, Agent, or Firm*—Trop Pruner & Hu PC

(57) ABSTRACT

A system for use in a subsea well includes a sealing element having an inner surface defining a bore through which a carrier line of a tool string may extend. A pressure-activated operator is coupled to the sealing element and is adapted to cause the sealing element to deform generally radially inwardly to allow the inner surface to apply a force to seal around the carrier line. A fluid pressure conduit extends from a sea surface pressure source to the pressure-activated operator. The sealing element is part of a pack-off device that can be used in a subsea blow-out preventer.

34 Claims, 5 Drawing Sheets

SEALING DEVICE FOR USE IN SUBSEA WELLS

BACKGROUND

The invention generally relates to sealing devices for use in subsea wells.

After a wellbore (in a land well or a subsea well) has been drilled, various operations are performed. Such operations may include logging, perforating, and other operations. In a typical land well, the wellhead equipment includes a lubricator that allows tool strings to be lowered into the wellbore. At the top of the lubricator may be a "stuffing box," which includes a sealing element that seals on the line carrying the tool string as the tool string is run into the well. The line carrying the tool string may be a wireline, a slickline, or a tubing. By sealing on the line, wellbore fluids are prevented from escaping through the wellhead equipment as the tool string is run into the well.

In a subsea well, a blow-out preventer (BOP) is typically located at the subsea well surface (generally referred to as the mud line). Wellbore equipment extends below the BOP into the subsea wellbore. A marine riser extends from the BOP to a sea surface vessel or platform. The marine riser includes a large tubing that isolates fluids in the marine riser from the sea water. Typically, control lines may be run on the outside of the marine riser to the surface vessel or platform. Such control lines may include fluid communication lines (e.g., hydraulic lines or gas pressure lines) and electrical lines. Thus, using the control lines, various types of fluids may be communicated to the BOP and equipment in the wellbore.

In performing logging or perforating operations in a subsea well, the inner bore of the marine riser in many instances is exposed to the wellbore of the subsea well. As logging or perforating tool strings are lowered through the BOP into the subsea wellbore, a sealing mechanism is typically not provided at the mud line during run-in. As a result, limitations are imposed on the types of operations that can be performed. For example, it may be desired to log in the subsea wellbore at an elevated pressure. However, because the marine riser is exposed to the wellbore fluid pressure, such elevated pressure may cause damage to the marine riser. Another example includes overbalanced perforation operations, where the wellbore pressure is raised to a level higher than the pressure of the target formation. In addition, sudden rises in wellbore pressure may occur during perforation operations. Because the marine riser is typically formed of relatively thin-walled tubing to reduce cost and weight of the marine riser, the marine riser may not be able to handle pressures above a certain level.

A need thus exists for a sealing mechanism provided at the mud line of a subsea wellbore during certain types of operations, such as logging or perforating operations.

SUMMARY

In general, in one embodiment of the invention, a system for use in a subsea well includes a sealing element having an inner surface defining a bore through which a carrier line of a tool string may extend. A pressure-activated operator is coupled to the sealing element and is adapted to cause the sealing element to deform radially inwardly to allow the inner surface to apply a force. A fluid pressure conduit extends from a sea surface pressure source to the pressure-activated operator.

Other embodiments and features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "below" and "above"; and other like terms indicating relative positions above or below a given point or element are used in this description to more clearly describe some embodiments of the invention. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
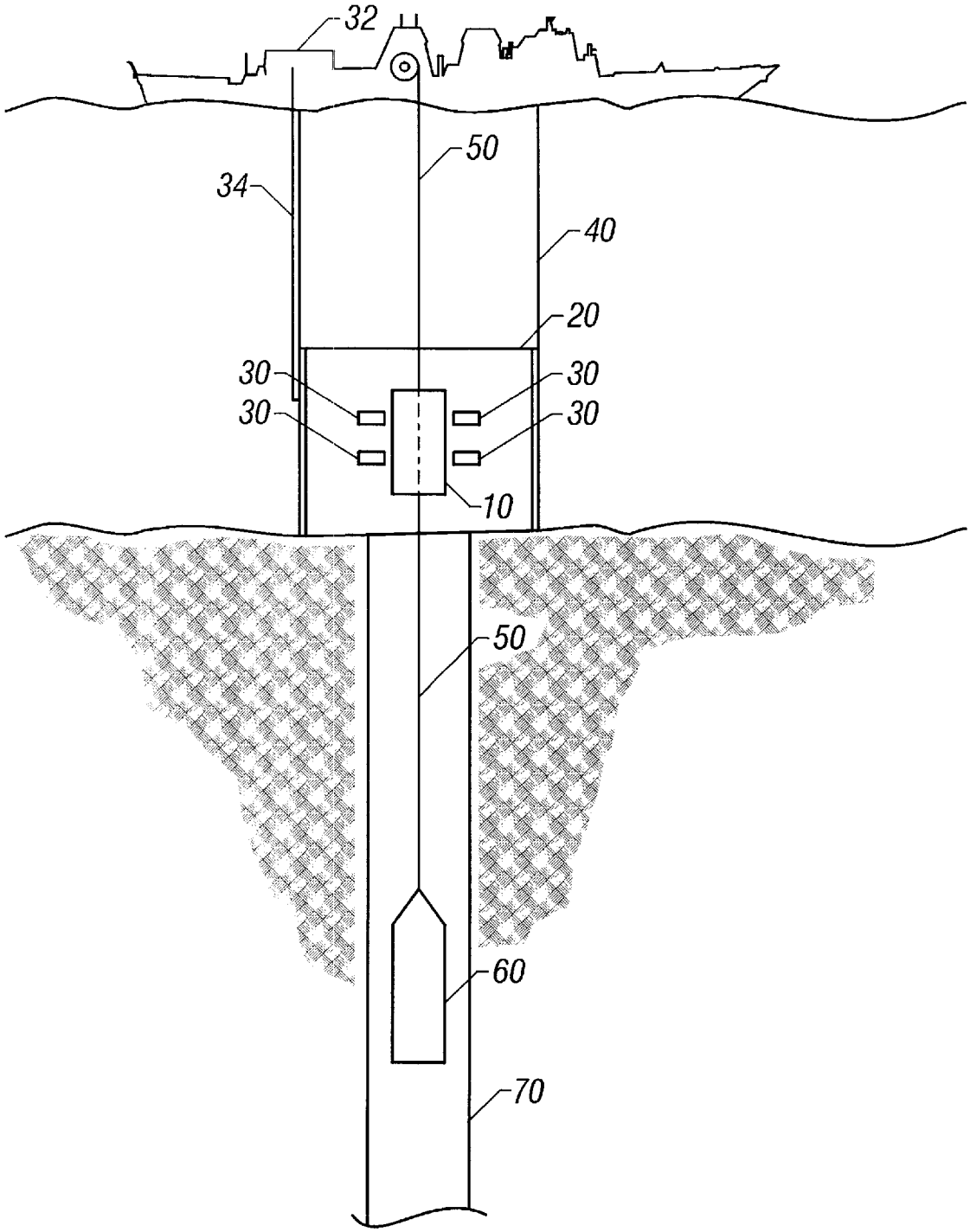
FIG. 1 is a schematic drawing of a subsea well string including a pack-off device in accordance with an embodiment of the invention.

Referring to FIG. 1, a subsea string includes a pack-off device 10 in accordance with an embodiment of the invention. A blow-out preventer 20 (hereinafter BOP 20) is located at the sea floor above the wellhead and below a marine riser 40. In other embodiments, other types of mud line equipment may be located at the sea floor. The pack-off device 10, as more fully described later, is used to control a subsea well at the BOP 20 level. The BOP 20 typically has a plurality of rams 30 that close on a pipe (e.g., a drilling pipe or other type of pipe or tubing) to prevent well blow out due to an unexpected increase in wellbore pressure.

In performing certain types of operations in the wellbore 70, an increased pressure may be present in the wellbore 70. One example is overbalanced perforating, in which a perforating gun is lowered into the wellbore having a pressure greater than the pressure of the target formation. Another example is open-hole logging in which a logging tool is lowered into the wellbore on a wireline. It may be desirable to log at a predetermined pressure. Also, it may be possible for the wellbore 70 to take fluid during logging that may require pressure control at the surface.

Using a landing string that extends from the surface platform to the BOP 20 to perform pressure control may be relatively expensive. Fluid pressure control inside the marine riser 40 may not be possible due to the relative structural weakness of the marine riser 40. To provide the desired fluid pressure control in accordance with some embodiments, the pack-off device 10 is used in conjunction with the BOP 20.

A tool 60 (e.g., a logging tool, a perforating string, or other tool) may be carried by a carrier line 50, which may be a wireline, slickline, or tubing (e.g., coiled tubing). The pack-off device 10 includes a sealing element to provide a seal around the carrier line 50. The sealing element in one example may be a dynamic seal that allows movement of the carrier line 50 (during run-in of the tool string) while providing the desired seal.

Figure 2:
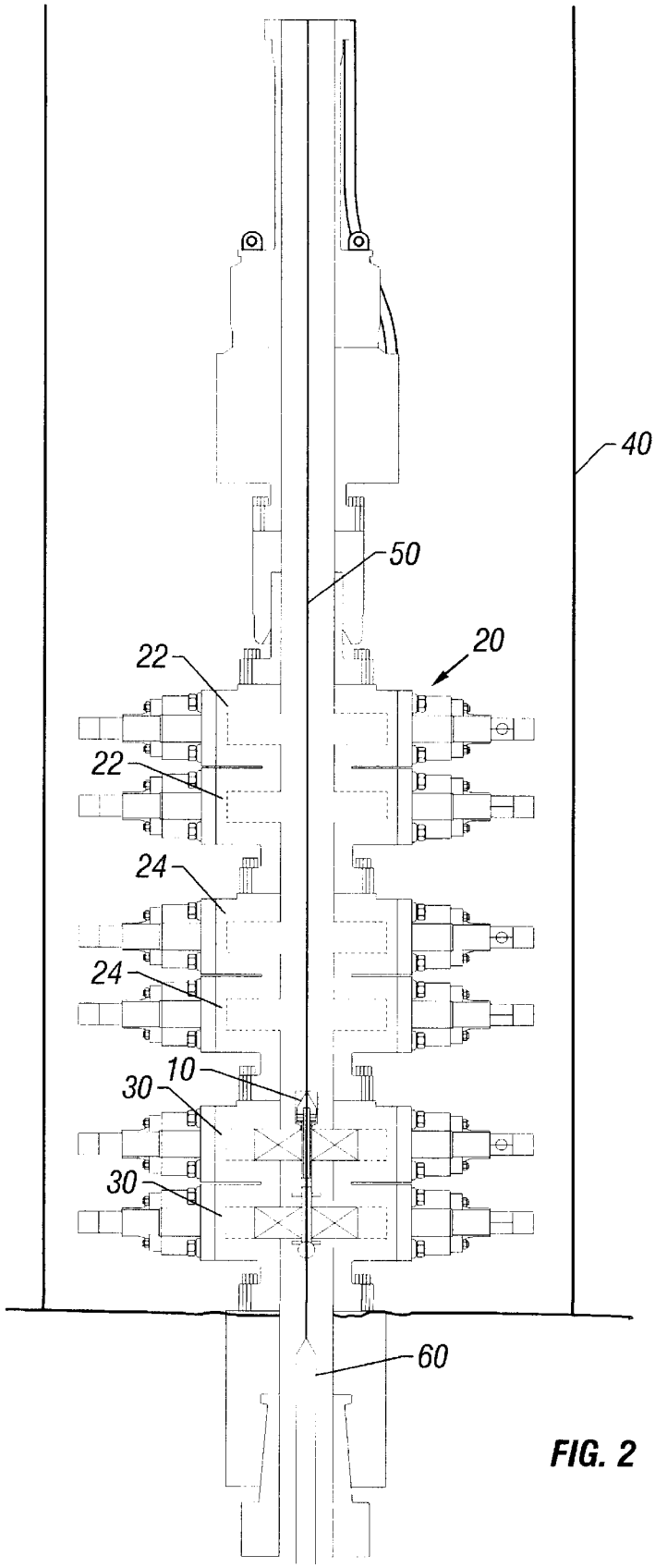
FIG. 2 illustrates a blow-out preventer including the pack-off device in the string of FIG. 1.

FIG. 2 shows the BOP 20 in greater detail including the pack-off device 10. In the illustrated embodiment, the BOP includes three sets of rams 22, 24, and 30. The rams 30 are used to close on a slick joint of the pack-off device 10, while the rams 22 and 24 may be used for other purposes, such as to close on a pipe or tubing. Also, the rams 30 inside the BOP 20 may be used independently of the pack-off device 10; that is, they may also be used with another device.

In accordance with one embodiment, the pack-off device 10 includes a pressure-activated mechanism. To communicate activating pressure from a surface pressure source 32 to the pack-off device 10, an existing choke line or kill line 34 of the BOP 20 may be used so that additional control lines are not needed. Alternatively, separate control lines may be used. The choke line or kill line 34, typically attached to the outside of the marine riser 40 and extending to the surface platform, is coupled to a choke port in the BOP 20. The choke port leads to the pressure-activated mechanism of the pack-off device 10. In other embodiments, another port in the BOP 20 may be used to provide the desired pressure.

In yet another embodiment, the pack-off device 10 includes a mechanism that is activable by low-level pressure pulse signals having predetermined amplitudes and periods. In a further embodiment, the pack-off device 10 includes a mechanical operator that may be operated by movement of the rams 30.

Figure 3:
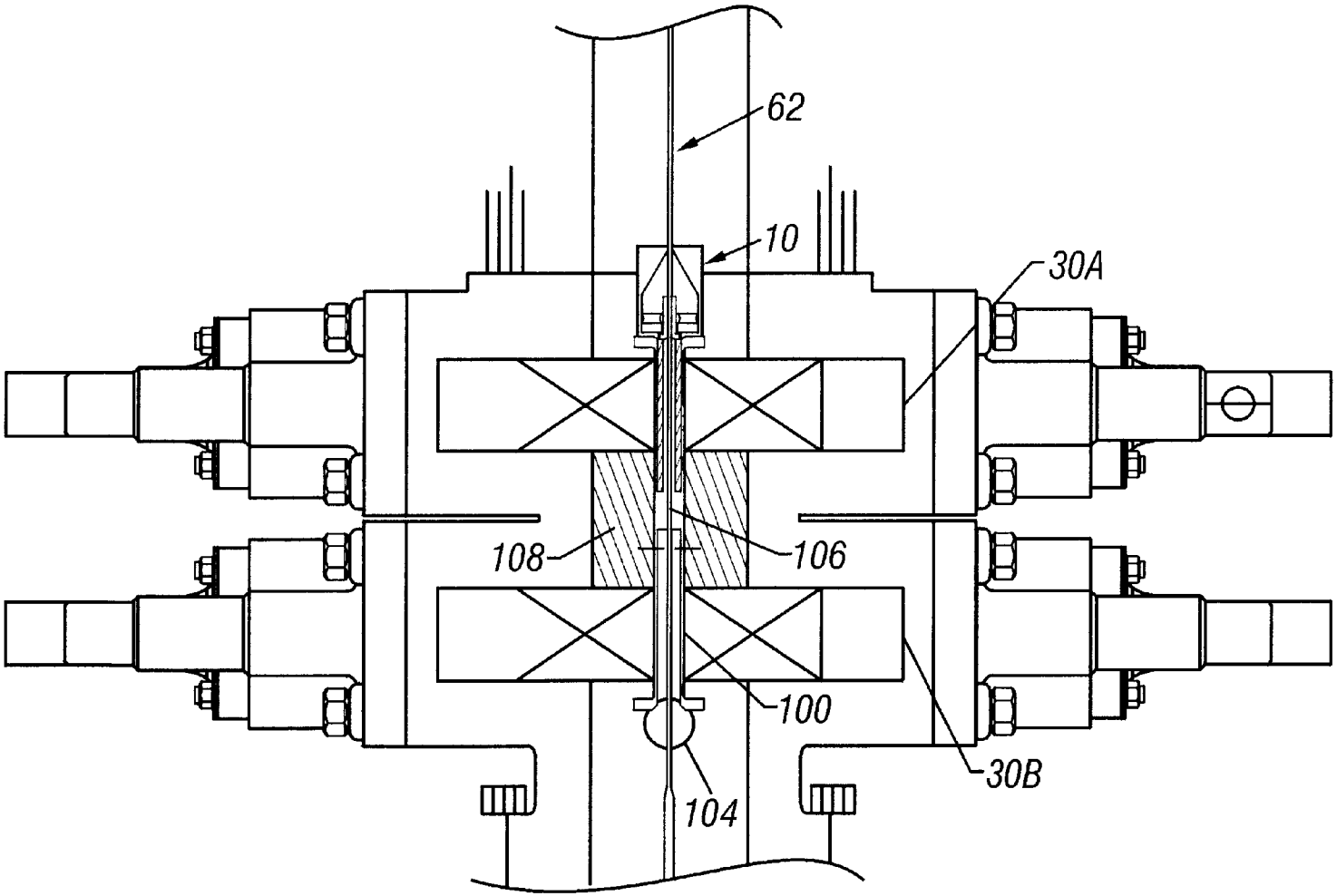
FIG. 3 illustrates in more detail a portion of the blow-out preventer of FIG. 2.

As further shown in FIG. 3, the outer surface of the pack-off device 10 includes a slick joint 99 on which the rams 30 (including an upper ram 30A and a lower ram 30B) may be sealingly engaged. The diameter of the housing of the pack-off device 10 may be varied to match different rams in the BOP 20. A choke port 106 leads into a chamber 108 defined between the rams 30A and 30B. A kill port 104 (which may be used to communicate fill fluids to kill the wellbore 70) may be positioned below the lower ram 30B. Once the rams 30A, 30B are sealingly engaged to the slick joint 99 of the pack-off device 10, the chamber 108 is sealed off from the rest of the BOP 20 so that pressure can be increased in the chamber 108 to provide the activating pressure.

Figure 4:
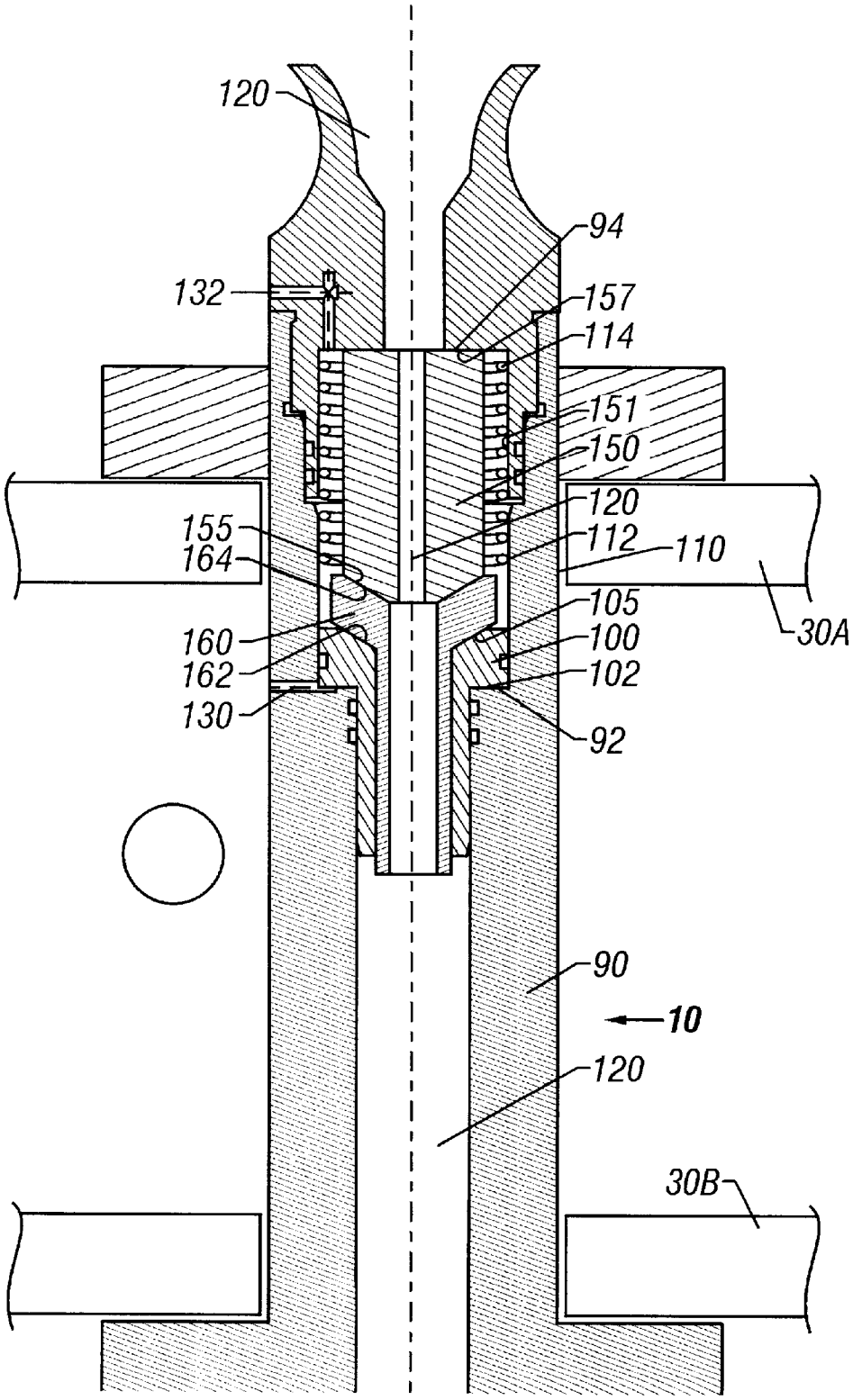
FIG. 4 is a cross-sectional view of the detailed structure of the pack-off device.

FIG. 4 shows the detailed structure of the pack-off device 10. The pack-off device includes a housing 90, generally tubular in shape and made of suitable metal selected for the subsea wellbore environment. The housing 90 has a lower shoulder 92 on which a piston 100 sits, and an upper shoulder 94 that acts as a fixed barrier against movement of a sealing element 150. The piston 100 is generally a cylindrical structure having a surface 102 that abuts the lower shoulder 92 of the housing 90 when the pack-off device 10 is not in operation. The piston 100 may be made of a suitable metal.

The pack-off device 10 also includes an intermediate engagement member 160 having a first intermediate engagement member slant surface 162 and a second intermediate engagement member slant surface 164. The upper portion of the piston 100 has a slant surface 105 that abuts against the first intermediate engagement member slant surface 162. The sealing element 150 has a sealing element slant surface 155 that abuts the second engagement member slant surface 164. The sealing element 150 also includes an upper surface 157 that abuts against the upper shoulder 94 of the housing so that the sealing element 150 is restrained from movement when the pack-off device 10 is in operation.

A helical spring 110 is positioned in a chamber 151 around the sealing element 150 to apply a downward force against the piston 100. The housing 90 has an inlet port 130 for receiving fluid under pressure, which is communicated to the lower surface 102 of the piston 100. The housing 90 also includes an outlet port 132 in communication with the chamber 151. The outlet port 132 leads to the inner bore of the marine riser 40. An inner bore 120 of the housing 90 is coaxially arranged with an inner bore 120 of the sealing element 150. The inner bore 120 of the sealing element 150 is adapted to receive the carrier line 62.

In operation, a string (e.g., a logging tool string, a perforating gun string, or other tool string) may be lowered through the marine riser 40 and into the wellbore 70. The tool string includes the tool 60, the carrier line 50, and the pack-off device 10 (FIG. 1). The pack-off device 10 is adapted to be engaged in the BOP 20 to provide a seal at the BOP level.

In some embodiments, a depth correlation log may be run before lowering the tool string into the wellbore 70. The depth correlation log may be run with a string including a casing collar locator (CCL) and the pack-off device 10 attached below the CCL. The string is lowered such that the pack-off device 10 is lowered past the rams 30 in the BOP 20. The CCL attached above the pack-off device 10 may then be used to locate the depth of the rams 30. The tool string can then be raised and the data collected by the CCL analyzed to determine the depth of the rams 30.

Next, the tool string may be run into the wellbore 70 again. After the pack-off device 10 is positioned at the desired depth, the pipe rams 30 may be closed onto the carrier line 50 to secure the pack-off device 10. An activating pressure can then be provided down the appropriate control line (e.g., the choke or kill line) from the surface platform to the chamber 108 (FIG. 3) defined between the rams 30. The activating pressure causes the piston 100 to apply an upward force against the intermediate engagement member 160, which in turn applies a pressure against the sealing element 150.

The slanted engagement surfaces 105, 162, 164, and 155 (of the piston 100, intermediate engagement member 160, and sealing element 150) enables the upward force on the piston 100 to be translated into a force applied at a vector perpendicular to the slanted surfaces. The vector has a radial portion that enables the sealing element 150 to deform radially inwardly to close on the carrier line 50 to provide a seal around the outer portion of the carrier line 50. After the pack-off device 10 has been activated to provide the desired seal inside the BOP 20, pressure inside the wellbore 70 may then be elevated to perform various tasks. Tasks may include moving the carrier line 50 while maintaining a pressure barrier between the well and the marine riser above the BOP. Certain well services such as a CBL log may be desirable to take measurements while the wellbore has increased pressure. The pack-off device 10 also provides a pressure control mechanism to keep sudden increases in wellbore pressure from being communicated to equipment at the surface platform or vessel. Such sudden wellbore pressure increases may pose a safety hazard.

If well control is needed at any time during the logging, perforating, or other operation in which the pack-off device 10 has created a seal around the carrier line 50, a kill fluid may be communicated down a kill fluid control line that leads to the kill fluid port 104. The kill fluid is then pumped into the wellbore 70 to kill and regain control of the well. Once well control is established, the pack-off device 10 may be released and logging or other operations may continue.

Figure 5:
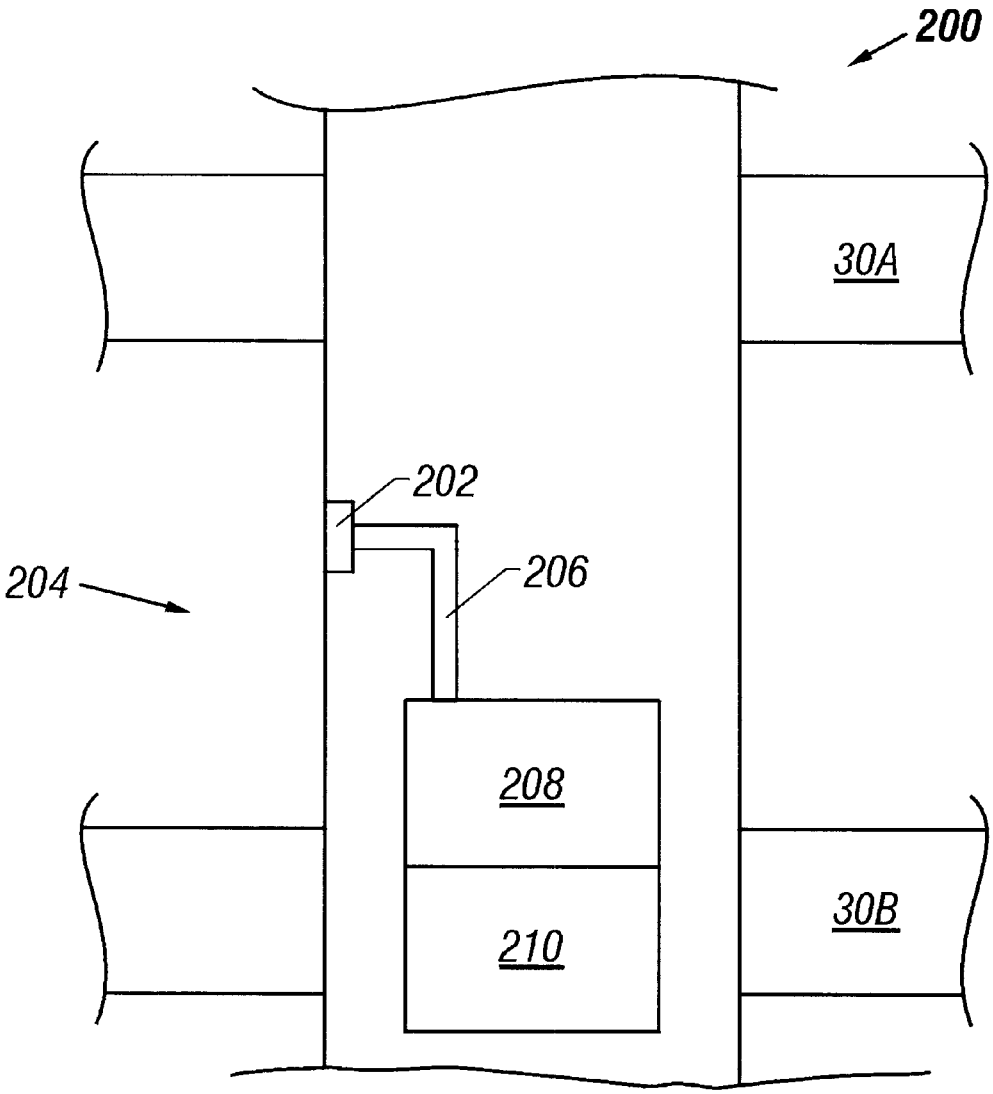
FIG. 5 illustrates a portion of a subsea well string including a mechanism activable by pressure communicated to a blow-out preventer.

Referring to FIG. 5, the pack-off device in accordance with other embodiments may be used to operate other types of devices, such as valves, sensors, packers, and so forth. As shown in FIG. 5, a pack-off device 200 may be positioned in the BOP 20 such that pipe rams 30A and 30B close on the outer surface of the pack-off device 200. An inlet port 202 may be in communication with a chamber 204 that is in turn in communication with the choke port of the BOP 20. Pressure can thus be provided down the choke line to the chamber 204, which pressure is communicated through the port 202 and a conduit 206 at least to an activating mechanism 208.

The activating mechanism 208 is shown positioned inside the pack-off device 200. However, in further embodiments, the activating mechanism 208 may be positioned lower in the string inside the wellbore 70. The activating mechanism 208 may be activated by an elevated pressure. Thus, the activating mechanism 208 may include a rupture disk assembly that is ruptured by a predetermined pressure level. The activating mechanism 208 may also include a counter that is responsive to plural pressure cycles before activation. In another embodiment, pressure pulse signals may be communicated to the chamber 204. Such pressure pulses have predetermined amplitudes and duration. Some embodiments of pressure pulse activated mechanisms are described in U.S. Pat. Nos. 4,896,722; 4,915,168 and Reexamination Certificate B1 4,915,168; 4,856,595; 4,796,699; 4,971,160; and 5,050,675, which are hereby incorporated by reference.

The activating mechanism 208 is operatively coupled to a device 210. Upon activation, the activating mechanism 208 is adapted to actuate the device 210, which may be a valve, a packer, a sensor, a control module, or some other element in a tool string. The device 210 may be located in the proximity of the BOP 20 or lower in the wellbore 70.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A system for use in a subsea well, comprising:

a sealing element having an inner surface defining a bore through which a carrier line of a tool string may extend;

a pressure-activated operator coupled to the sealing element and adapted to cause the sealing element to deform generally radially inwardly to allow the inner surface of the sealing element to apply a force;

a fluid pressure conduit extending from a sea surface pressure source to the pressure-activated operator; and a housing having an outer surface and containing the sealing element; and a blow-out preventer including one or more rams sealingly engageable with the housing outer surface.

2. The system of claim 1, wherein the blow-out preventer includes plural rams, and wherein the housing can have one of plural diameters to match different ones of the rams in the blow-out preventer.

3. The system of claim 1, further comprising:

a sealed chamber formed when the one or more rams are sealingly engaged to the housing outer surface; and a port in communication with the fluid pressure conduit and leading into the sealed chamber.

4. The system of claim 3, wherein the pressure-activated operator is in communication with the sealed chamber.

5. The system of claim 1, further comprising a tubing extending from a sea surface to the subsea well, the fluid pressure conduit being attached to the tubing.

6. The system of claim 1, wherein the pressure-activated operator includes a piston, a first chamber on one side of the piston, and a second chamber on another side of the piston.

7. The system of claim 6, wherein the first chamber is in communication with the fluid pressure conduit.

8. The system of claim 7, further comprising a pressure region in communication with the second chamber.

9. A system comprising:

a sealing element having an inner surface defining a bore through which a carrier line of a tool string may extend;

a pressure-activated operator coupled to the sealing element and adapted to cause the sealing element to deform generally radially inwardly to allow the inner surface of the sealing element to apply a force;

a fluid pressure conduit extending from a sea surface pressure source to the pressure-activated operator;

wherein the pressure-activated operator includes a piston, a first chamber on one side of the piston, and a second chamber on another side of the piston, the first chamber being in communication with the fluid pressure conduit;

a pressure region in communication with the second chamber; and a tubing extending to a sea surface, the pressure region being located in the tubing.

10. The system of claim 9, further comprising a marine riser including the tubing.

11. A tool string for use in a subsea well having mud line equipment, comprising:

a tool;

a carrier line; and a device adapted to engage the mud line equipment and having a sealing element including a bore through which the carrier line is extendible, the device further including an operator adapted to apply a radial force against the sealing element to cause the sealing element to seal around the carrier line, the tool, the carrier line, and the device being part of the tool string.

12. The tool string of claim 11, wherein the mud line equipment includes a blow-out preventer, the device adapted to cooperate with the blow-out preventer to actuate the operator.

13. The tool string of claim 11, wherein the device has a housing and the mud line equipment includes one or more sealing members, the device comprising a housing adapted to sealingly engage the one or more sealing elements.

14. The tool string of claim 13, wherein the operator includes a pressure-activated operator.

15. The tool string of claim 11, wherein the operator is adapted to be activated by one or more pressure pulse signals.

16. The tool string of claim 11, wherein the device is adapted to cooperate with the mud line equipment to actuate the operator.

17. The tool string of claim 11, wherein the device is adapted to be carried on the carrier line.

18. The tool string of claim 11, wherein the tool, carrier line, and device are separate from the mud line equipment.

19. A tool string for use in a subsea well having mud line equipment, comprising:

a tool;

a carrier line; and a device adapted to engage the mud line equipment and having a sealing element including a bore through which the carrier line is extendible, the device further including an operator adapted to apply a radial force against the sealing element to cause the sealing element to seal around the carrier line, wherein the operator is adapted to be activated by movement of one or more moveable members in the mud line equipment.

20. The tool string of claim 19, wherein the operator is adapted to be activated by movement of one or more pipe rams, the one or more moveable members comprising the one or more pipe rams.

21. A method of operating a tool string in a subsea wellbore, comprising:

running the tool string including a tool, a carrier line, and a pack-off device into the subsea wellbore;

positioning the pack-off device proximal mud line equipment;

actuating one or more sealing members in the mud line equipment to sealingly engage an outer surface of the pack-off device; and providing an actuating signal to the pack-off device to cause the pack-off device to seal around the carrier line.

22. The method of claim 21, wherein providing the actuating signal includes providing an elevated pressure.

23. The method of claim 22, wherein providing the elevated pressure includes providing an elevated pressure to a pressure-activated operator of the pack-off device.

24. The method of claim 21, wherein actuating the one or more sealing members includes actuating one or more pipe rams of a blow-out preventer.

25. The method of claim 24, further comprising creating a sealed chamber once the one or more sealing members are sealingly engaged to the pack-off device outer surface.

26. The method of claim 25, wherein providing the actuating signal includes providing a pressure signal.

27. The method of claim 21, wherein providing the actuating signal comprises providing the actuating signal to cause activation of a sealing element in the pack-off device to seal around the carrier line.

28. A system for operating a tool in a subsea wellbore, comprising:

a housing;

mud line equipment having one or more sealing members to sealingly engage the housing, a sealed chamber formed by the sealing engagement; and an activating mechanism responsive to a pressure signal in the sealed chamber.

29. The system of claim 28, wherein the mud line equipment includes a blow-out preventer, and the one or more sealing members include pipe rams.

30. The system of claim 28, wherein the pressure signal includes an elevated pressure.

31. The system of claim 28, wherein the pressure signal includes a pressure pulse signal.

32. A system for use in a subsea well, comprising:

a pack-off device having a bore to receive a carrier line of a tool string, the pack-off device comprising a sealing element; and mud line equipment having at least one moveable member adapted to engage the pack-off device to operate the sealing element of the pack-off device to seal around the carrier line, wherein a sealed chamber is formed by engagement of the at least one moveable member and the pack-off device, wherein an elevated pressure is communicated to the sealed chamber to operate the pack-off device.

33. A system for use in a subsea well, comprising:

a pack-off device having a bore to receive a carrier line of a tool string, the pack-off device comprising a sealing element; and mud line equipment having at least one moveable member adapted to engage the pack-off device to operate the sealing element of the pack-off device to seal around the carrier line, wherein a sealed chamber is formed by engagement of the at least one moveable member and the pack-off device, wherein a pressure pulse signal is communicated to the sealed chamber to operate the pack-off device.

34. A system for use in a subsea well, comprising:

a pack-off device having a bore to receive a carrier line of a tool string, the pack-off device comprising a sealing element; and mud line equipment having at least one moveable member adapted to engage the pack-off device to operate the sealing element of the pack-off device to seal around the carrier line, wherein the at least one moveable member includes a pipe ram.

* * * * *